US010410591B1

(12) United States Patent
Shi et al.

(10) Patent No.: US 10,410,591 B1
(45) Date of Patent: Sep. 10, 2019

(54) LIQUID CRYSTAL DISPLAY DEVICE WITH RGB BACKLIGHT

(71) Applicant: Facebook Technologies, LLC, Menlo Park, CA (US)

(72) Inventors: Jianru Shi, Union City, CA (US); Fenglin Peng, Orlando, FL (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 15/652,639

(22) Filed: Jul. 18, 2017

Related U.S. Application Data

(60) Provisional application No. 62/363,831, filed on Jul. 18, 2016.

(51) Int. Cl.
*G09G 3/36* (2006.01)
*G09G 3/34* (2006.01)
*G09G 3/20* (2006.01)

(52) U.S. Cl.
CPC ..... *G09G 3/3413* (2013.01); *G09G 3/2003* (2013.01); *G09G 3/36* (2013.01); *G09G 2320/0242* (2013.01); *G09G 2320/0646* (2013.01)

(58) Field of Classification Search
None
See application file for complete search history.

(56) References Cited

U.S. PATENT DOCUMENTS 6,385,466 B1 * 5/2002 Hirai ..... G09G 3/3413 455/158.2
2008/0130087 A1 * 6/2008 Miyata ..... G02B 26/004 359/267
2008/0266331 A1 * 10/2008 Chen ..... G09G 3/3406 345/690
2014/0139561 A1 * 5/2014 Lee ..... G09G 3/003 345/690
2015/0161932 A1 * 6/2015 Kure ..... G09G 3/3426 345/690

* cited by examiner

*Primary Examiner* — Carl Adams
(74) *Attorney, Agent, or Firm* — Fenwick & West LLP

(57) ABSTRACT

An electronic display comprises a backlight unit and a liquid crystal (LC) layer, wherein the backlight combines and directs light from a plurality of light sources towards the LC layer, which controls an amount of light to be displayed. The light sources comprise at least two different types of light sources associated with different wavelength ranges, to provide improved spectrum intensity for a wider range of wavelengths. The intensity of the light sources may be adjusted based upon the input data for an image to be displayed. For example, the light sources may be dimmed based upon a determined amount of the received image data associated with a particular gray level.

14 Claims, 5 Drawing Sheets

LIQUID CRYSTAL DISPLAY DEVICE WITH RGB BACKLIGHT

CROSS REFERENCE TO RELATED APPLICATIONS

This application claims the benefit of U.S. Provisional Application No. 62/363,831, filed Jul. 18, 2016, which is incorporated by reference in its entirety.

BACKGROUND

The present disclosure generally relates to a liquid crystal display device having improved color purity.

Liquid crystal displays typically comprise a backlight unit and a liquid crystal (LC) layer. The backlight unit contains a light source and is configured to project light from the light source towards the LC layer, which modulates an amount of light from the backlight to be displayed. The light source for the backlight may comprise a white light source such as a white LED.

Figure 1:
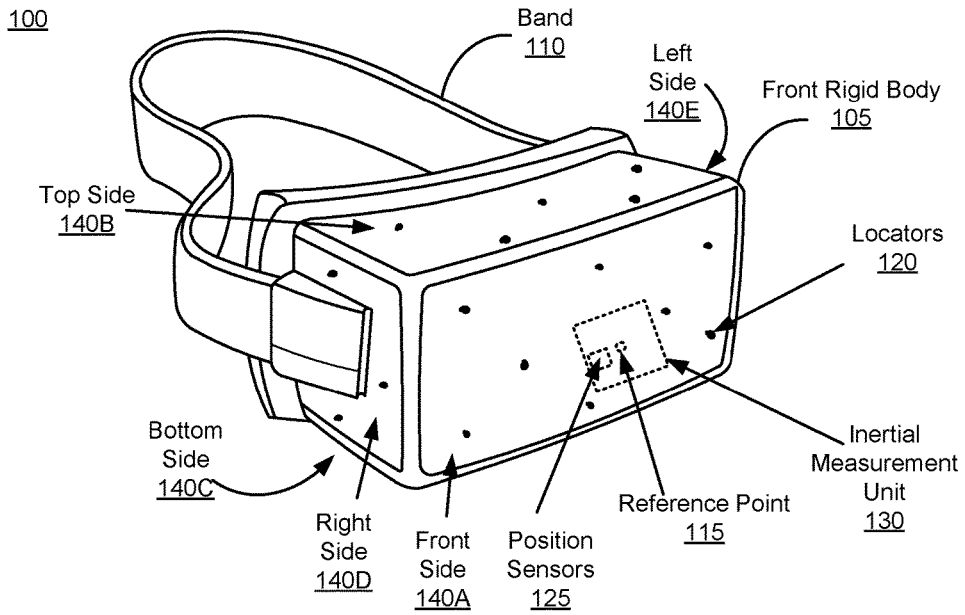
FIG. 1 is a diagram of a headset, in accordance with an embodiment.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

SUMMARY

In embodiments of the invention, an electronic display device includes a backlight unit and an LC layer. The backlight unit comprises a light source assembly having at least two different types of light sources that projects light of different wavelength ranges based upon a received light intensity control signal. The backlight unit combines the light from the plurality of light sources and projects the combined light in at least a first direction towards the LC layer. The LC layer receives the light from the backlight unit and controls an amount of light from the backlight unit to be displayed based upon a received liquid crystal control signal. The electronic display device further comprises a controller that receives input image data corresponding to an image to be displayed. The controller determines an amount of the received image data associated with a particular gray level and determines a dimming factor based upon that determined amount. The controller generates the liquid crystal control signal based upon the received input image data and generates the light intensity control signal, where the light intensity control signal is modified based upon the determined dimming factor.

Because the backlight combines light from a plurality of different light sources that have different wavelength ranges, improved spectrum intensity for a wider range of wavelengths may be achieved. For example, in some embodiments the light source comprises a red light source, a green light source, and a blue light source. In some embodiments, the electronic display device adjusts a brightness or intensity of one or more of the light sources in response to input image data corresponding to an image to be displayed. For example, in response to a determination that the input image data is not associated with a wavelength range corresponding to a particular light source type of the plurality of light sources, the electronic display device modifies the light intensity control signal to not drive the light source of that type.

The electronic display device may also analyze the input image data to determining a dimming factor for the plurality of light sources. For example, the electronic display device may determine a dimming factor based upon an amount of the input image associated with a particular gray level. In some embodiments, the dimming factor is based upon a number of pixels of the input image data having a gray level of '0' satisfying one or more threshold values. By adjusting intensity of light output by the light sources according to the input image data as described herein, an image with a low luminance level (e.g., a dark color) can be displayed.

DETAILED DESCRIPTION

Configuration Overview

Example embodiments of disclosed configurations include a liquid crystal display (LCD) device having improved color purity for a predetermined color.

Color purity herein refers to a degree of closeness of wavelength of light to a target wavelength of a desired color. For example, if a target wavelength of a blue color is 475 nm, light having a narrower bandwidth (or concentrated energy) around the target wavelength 475 nm will have higher color purity for the blue color than light having a wider bandwidth (or scattered energy). For a black color, an absence of visible light is considered a pure black color.

In one or more embodiments, the disclosed liquid crystal display device includes (i) a plurality of light sources, (ii) a backlight unit, and (iii) a liquid crystal layer. The plurality of light sources project light with different colors to the backlight unit. Light from different light sources is combined by the backlight unit, and the combined light is projected to the liquid crystal layer. The combined light has improved spectrum intensity throughout different wavelengths corresponding to the different colors. Accordingly, purity of a predetermined color displayed on the LCD device can be improved.

In one or more embodiments, the plurality of light sources are controlled according to input image data. The input image data represent color components and/or gray level of pixels in a single image. In one aspect, light sources corresponding to colors that do not contribute to a color in the single image may be turned off.

In one or more embodiments, intensity of light emitted from one or more light sources is adjusted according to a gray level distribution of the input image (i.e., a distribution of gray levels of pixels of the input image). In one aspect, the one or more light sources are controlled to output light corresponding to the gray level distribution of the input image data. Responsive to determining the gray level distribution indicating a plurality of pixels having gray level values within a predetermined threshold value, the one or more light sources adjust intensity of light accordingly. Hence, the LCD device can display an image having a dark color (e.g., low luminance value) by reducing intensity of light from the one or more light sources.

System Overview

FIG. 1 is a diagram of a headset 100, in accordance with an embodiment. In one embodiment, the headset 100 includes a front rigid body 105 and a band 110. The front rigid body 105 includes an electronic display (not shown), an inertial measurement unit (IMU) 130, one or more position sensors 125, and locators 120. In one embodiment, a user movement is detected by use of the inertial measurement unit 130, position sensors 125, and/or the locators 120, and an image is presented to a user through the electronic display according to the user movement detected. In one embodiment, the headset 100 can be used for presenting a virtual reality, an augmented reality, or a mixed reality to a user.

A position sensor 125 generates one or more measurement signals in response to motion of the headset 100. Examples of position sensors 125 include: one or more accelerometers, one or more gyroscopes, one or more magnetometers, another suitable type of sensor that detects motion, a type of sensor used for error correction of the IMU 130, or some combination thereof. The position sensors 125 may be located external to the IMU 130, internal to the IMU 130, or some combination thereof. In the embodiment shown by FIG. 1, the position sensors 125 are located within the IMU 130, and neither the IMU 130 nor the position sensors 125 are visible to the user.

Based on the one or more measurement signals from one or more position sensors 125, the IMU 130 generates calibration data indicating an estimated position of the headset 100 relative to an initial position of the headset 100. In some embodiments, the IMU 130 rapidly samples the measurement signals and calculates the estimated position of the headset 100 from the sampled data. For example, the IMU 130 integrates the measurement signals received from the accelerometers over time to estimate a velocity vector and integrates the velocity vector over time to determine an estimated position of a reference point on the headset 100. Alternatively, the IMU 130 provides the sampled measurement signals to a console (e.g., a computer), which determines the calibration data. The reference point is a point that may be used to describe the position of the headset 100. While the reference point may generally be defined as a point in space; however, in practice the reference point is defined as a point within the headset 100 (e.g., a center of the IMU 130).

The locators 120 are located in fixed positions on the front rigid body 105 relative to one another and relative to a reference point 115. In the example of FIG. 1, the reference point 115 is located at the center of the IMU 130. Each of the locators 120 emits light that is detectable by an imaging device (e.g., camera or an image sensor). Locators 120, or portions of locators 120, are located on a front side 140A, a top side 140B, a bottom side 140C, a right side 140D, and a left side 140E of the front rigid body 105 in the example of FIG. 1.

Figure 2:
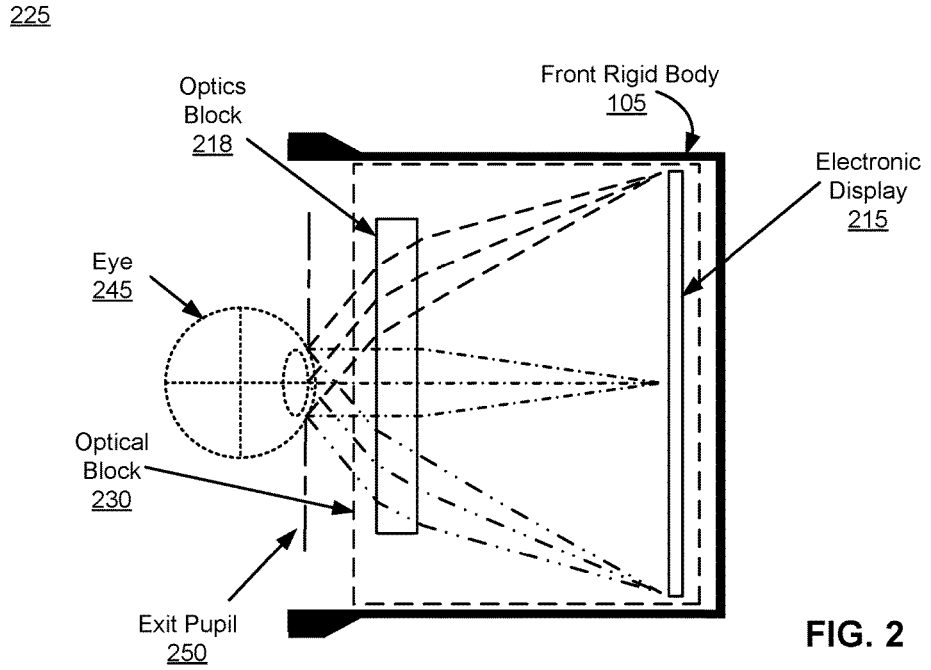
FIG. 2 is a cross section of a front rigid body of the headset in FIG. 1, in accordance with an embodiment.

FIG. 2 is a cross section 225 of the front rigid body 105 of the embodiment of the headset 100 shown in FIG. 1. As shown in FIG. 2, the front rigid body 105 includes an optical block 230 that provides altered image light to an exit pupil 250. The exit pupil 250 is the location of the front rigid body 105 where a user's eye 245 is positioned. For purposes of illustration, FIG. 2 shows a cross section 225 associated with a single eye 245, but another optical block, separate from the optical block 230, provides altered image light to another eye of the user.

The optical block 230 includes an electronic display 215, and the optics block 218. The electronic display 215 emits image light toward the optics block 218. The optics block 218 magnifies the image light, and in some embodiments, also corrects for one or more additional optical errors (e.g., distortion, astigmatism, etc.). The optics block 218 directs the image light to the exit pupil 250 for presentation to the user. In one or more embodiments, the optics block 218 may be omitted.

Figure 3:
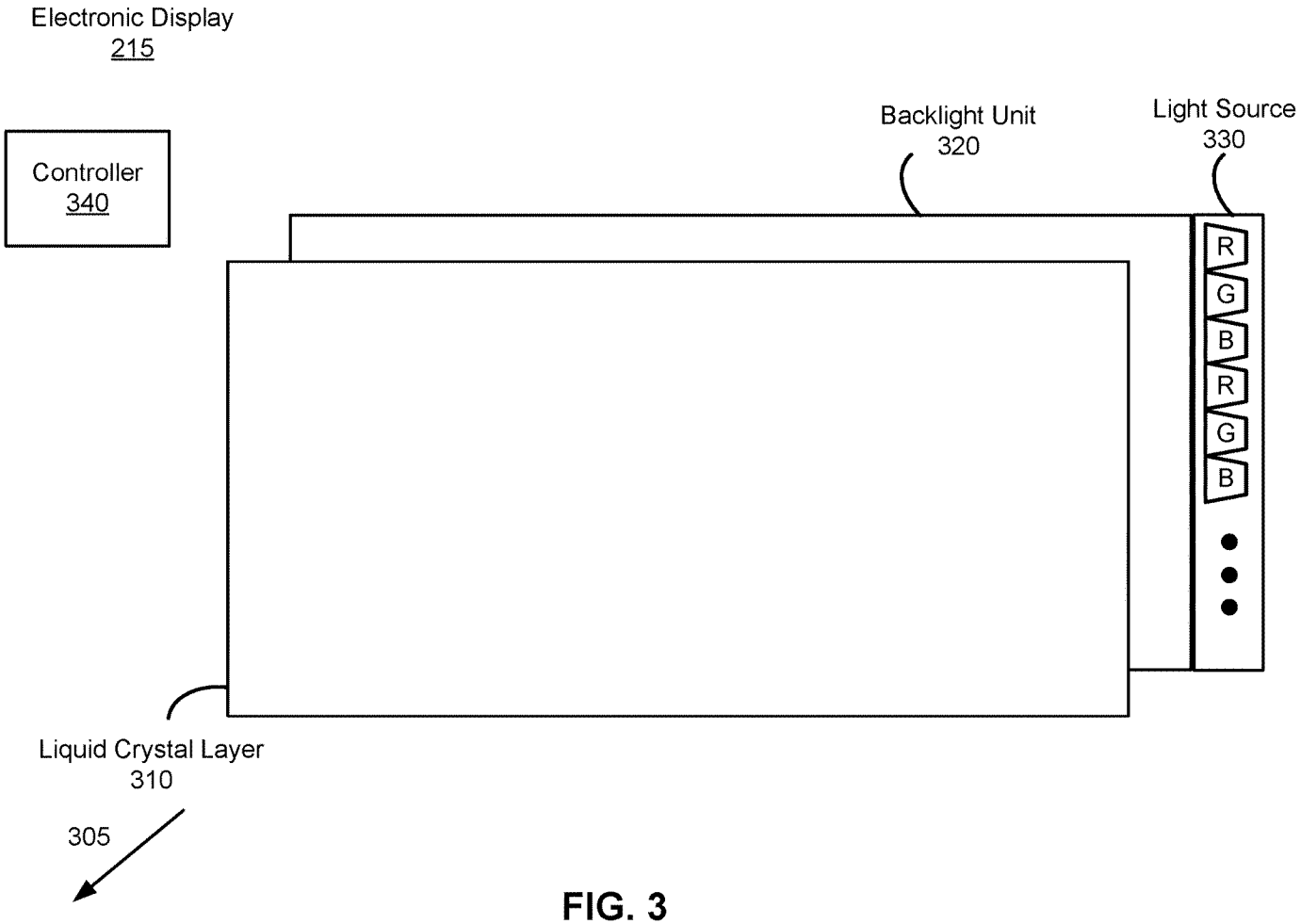
FIG. 3 is a detailed diagram of an electronic display with improved color purity for a predetermined color, in accordance with an embodiment.

FIG. 3 is a detailed diagram of an electronic display with improved color purity for a predetermined color, in accordance with an embodiment. In one embodiment, the electronic display 215 is a LCD device including a liquid crystal layer 310, a backlight unit 320, a light source 330, and a controller 340. The backlight unit 320 emits light towards the exit pupil 250 through the liquid crystal layer 310 in a direction 305. The liquid crystal layer 310 is disposed between the backlight unit 320 and the exit pupil 250, and controls an amount of light from the backlight unit 320 to pass through in the direction 305. A space between the liquid crystal layer 310 and the backlight unit 320 may be vacuum or filled with transparent material. In other embodiments, the electronic display 215 includes different, more or fewer components than shown in FIG. 3. For example, the electronic display 215 may include a color filter, a light defusing component, and/or a polarizer.

In one embodiment, the light sources 330 are coupled to a side of the backlight unit 320, and provide light to the backlight unit 320. In one example, the light sources 330 include a red light source, a green light source, and a blue light source, where each light source outputs light with a corresponding color (e.g., a red light source outputs red light, a green light source outputs green light, and a blue light source outputs blue light). In one implementation, groups of light sources 330 are disposed linearly on the side of the backlight unit 320, where each group comprises a red light source, a green light source, and a blue light source. In other embodiments, the light sources may include light sources with different colors or in different sequence.

In one embodiment, a light source 330 is an electrical component that generates light. The light source may comprise a light emitting component (e.g., a light emitting diode (LED), a light bulb, or other components for emitting light). In one aspect, intensity of light from a light source 330 is adjusted according to a light intensity control signal from the controller 340. The light intensity control signal is a signal indicative of intensity of light to be output for each light source 330. Different light sources 330 can output corresponding light with different intensity, according to the light intensity control signal. For example, a red light source outputs red light with an intensity corresponding to '10' out of '255', a green light source outputs green light with an intensity corresponding to '30' out of '255', and a blue light source outputs blue light with an intensity corresponding to '180' out of '255,' according to the light intensity control signal. A light source may adjust its duty cycle of or an amount of current supplied to the light emitting component (e.g., LED), according to the light intensity control signal. For example, reducing current supplied to the LED or reducing 'ON' duration of the duty cycle renders intensity of light from a light source to be reduced (i.e., light to be dimmed).

The backlight unit 320 receives light from the light sources 330, and obtains combined light having a color corresponding to a combination of colors of the received light. The backlight unit 320 may include a lightguide composed of a glass material or a transparent plastic material, and refractive and/or reflective components for projecting light towards the liquid crystal layer 310. The lightguide receives light with different colors from the light sources 330, and projects combined light including a combination of the different colors towards the liquid crystal layer 310. The combined light (e.g., white light) may have improved spectrum intensity across different wavelengths, as described in detail below with respect to FIGS. 4A and 4B.

The liquid crystal layer 310 receives a liquid crystal control signal from the controller 340, and passes light from the backlight unit 320 towards the exit pupil in the direction 305, according to the liquid crystal control signal. The liquid crystal control signal is a signal indicative of an amount of light passing through the liquid crystal layer 310 for different pixels. The liquid crystal layer 310 includes a plurality of liquid crystals, and a configuration of the liquid crystals can be changed according to the light crystal control signal applied across electrodes of the liquid crystal layer 310. In one example, a first portion of the liquid crystals corresponding to a first pixel of an image passes through 30% of light from the backlight unit 320, and a second portion of the liquid crystals corresponding to a second pixel of the image passes through 80% of light from the backlight unit 320, according to the liquid crystal control signal. Thus, the liquid crystal layer 310 can pass through different amount of light for different pixels, according to the liquid crystal control signal.

The controller 340 is a circuit component that receives an input image data, and generates control signals for driving the liquid crystal layer 310 and the light sources 330. The input image data may correspond to an image or a frame of a video in a virtual reality and/or augmented reality application. The controller 340 generates the light intensity control signal for controlling intensity of light output by the light sources 330, according to the input image data. In addition, the controller 340 generates the liquid crystal control signal to determine an amount of light passing from the backlight unit 320 towards the exit pupil 250 through the liquid crystal layer 310. The controller 340 provides the light intensity control signal to the light sources 330, and the liquid crystal control signal to the liquid crystal layer 310 at a proper timing to display a single image.

In one embodiment, the controller 340 generates the light intensity control signal, according to one or more colors of an input image described by the input image data. Assuming for an example, if the entire image is a single color of either red, green, or blue with uniform or non-uniform intensity for different pixels, other light sources corresponding to other colors can be turned off. Assuming for another example, if the entire image is a single color of a mix of two or more colors (e.g., either magenta, or cyan, or yellow) with uniform or non-uniform intensity for different pixels, light sources that do not contribute to the single color can be turned off.

In one embodiment, the controller 340 generates the light intensity control signal, according to a gray level distribution of the input image described by the input image data. In one example, the controller 340 obtains a number of pixels having a gray level (also referred to as "a gray scale level") of '0'. Moreover, the controller 340 generates the light intensity control signal according to the number of pixels having gray level of '0'. Assuming for an example, if the number of pixels having a gray level of '0' is over a first predetermined number (e.g., 40% of the total number of entire pixels), then the controller 340 generates the light intensity control signal to dim the light sources by a first amount (e.g., 10%) corresponding to the first predetermined number. In addition, if the number pixels having a gray level of '0' is over a second predetermined number (e.g., 80% of the total number of the entire pixels), then the controller 340 generates the light intensity control signal to further dim the light sources by a second amount (e.g., 30%) corresponding to the second predetermined number. In case the entire input image is black, the controller 340 generates the light intensity control signal in another state that indicates the light sources 330 to turn off. Accordingly, the backlight unit 320 can be dimmed according to a gray level distribution of the input image, thus an image having a low luminosity (e.g., black color) can be displayed.

Figure 4A:
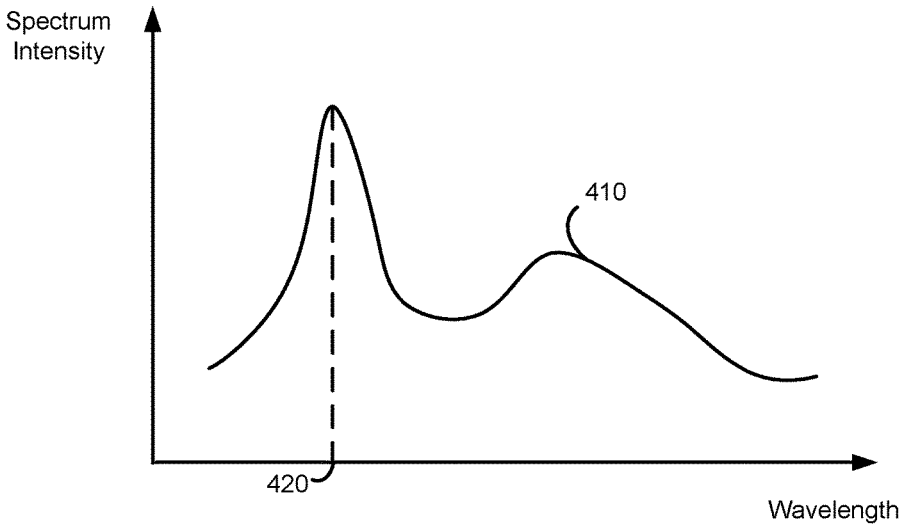
FIG. 4A illustrates a spectrum intensity of white light generated by a single light source.

FIG. 4A illustrates a spectrum intensity of white light generated by a single light source (e.g., a white LED). A spectrum intensity plot 410 represents spectrum intensity across different wavelengths (or frequency). The white light generated by a single light source has varying light intensity across different wavelengths. For example, the spectrum intensity plot 410 has a peak at a wavelength 420, and has lower spectrum intensity at other wavelengths. Accordingly, some color components corresponding to the other wavelengths may have reduced intensity than a color component corresponding to the wavelength 420.

Figure 4B:
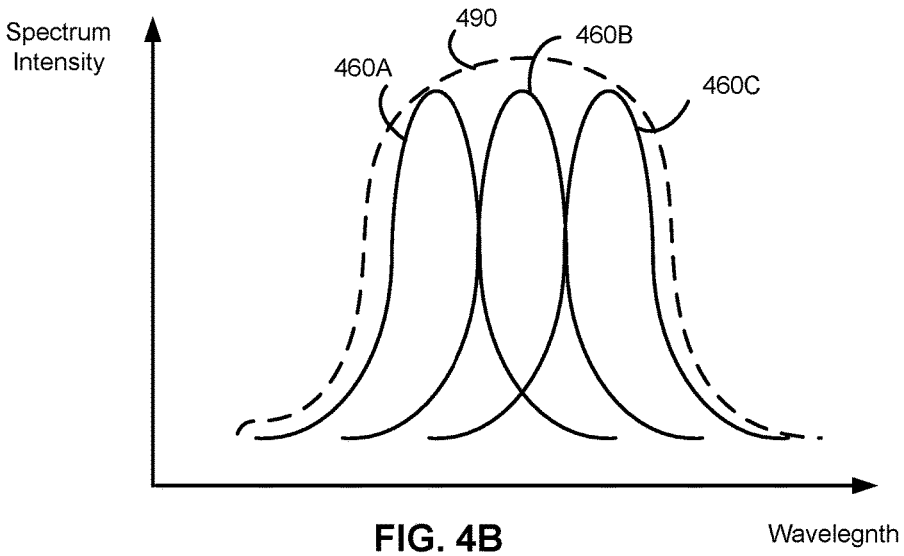
FIG. 4B illustrates a spectrum intensity of white light generated by a plurality of light sources, in accordance with an embodiment.

FIG. 4B illustrates a spectrum intensity plot of white light generated by a plurality of light sources, in accordance with an embodiment. In one example, a spectrum plot 460A represents spectrum intensity of blue light output by a blue light source, a spectrum plot 460B represents spectrum intensity of green light output by a green light source, and a spectrum plot 460C represents spectrum intensity of red light output by a red light source. As shown by the spectrum plots 460A, 460B, 460C, different light sources emit light with similar intensity at corresponding wavelengths. By combining light from different light sources, combined light having a spectrum plot 490 can have relatively flat intensity for a wide range of wavelengths. A homogenizing film can improve the uniformity of the spectrum intensity for a wider range of wavelengths. Thus, improved colors, for example, in red, green, blue, cyan, magenta, yellow and black can be displayed. As a result, purity of colors displayed on the electronic display device can be improved.

Figure 5:
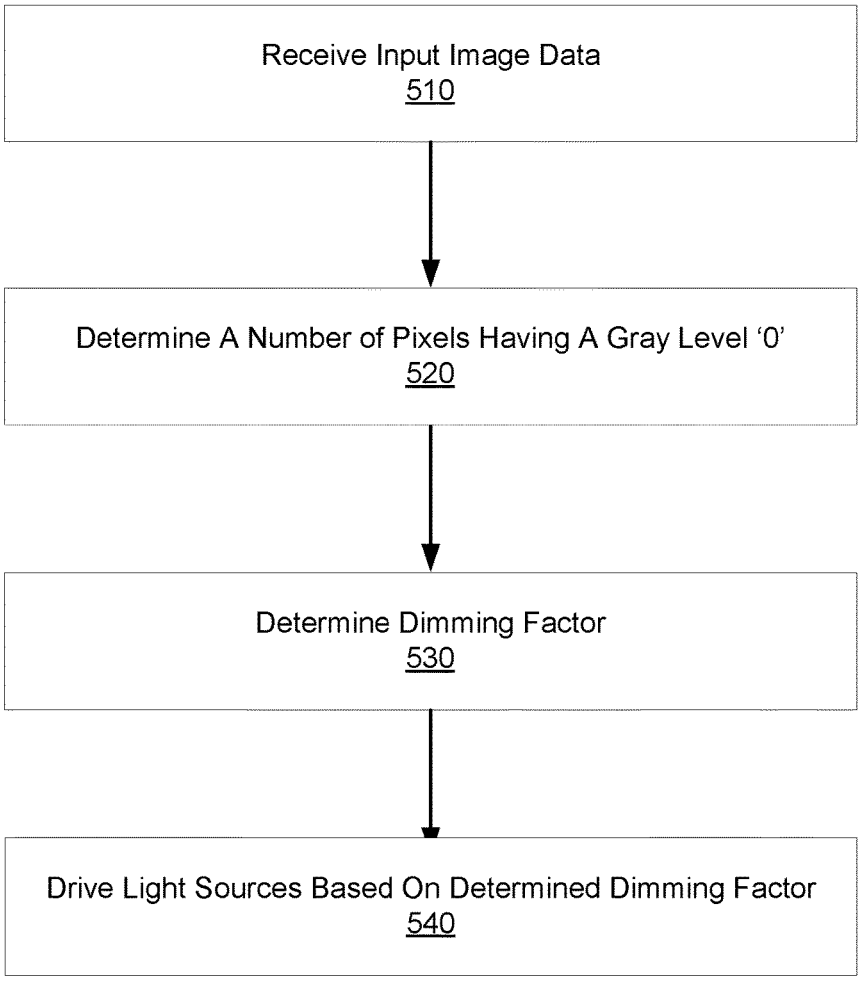
FIG. 5 illustrates an example process of driving light sources, in accordance with an embodiment.

FIG. 5 illustrates an example process of driving a plurality of light sources, in accordance with an embodiment. The steps in FIG. 5 can be performed by, for example, the controller 340 of FIG. 3. In other embodiments, some or all of the steps may be performed by other entities. In addition, some embodiments may perform the steps in parallel, perform the steps in different orders, or perform different steps.

The controller 340 receives 510 an input image data of an input image.

The controller 340 determines 520 a number of pixels having a gray level '0', and determines 530 a dimming factor corresponding to the determined number of pixels. Moreover, the controller 340 drives 540 light sources based on the determined dimming factor.

Figure 6:
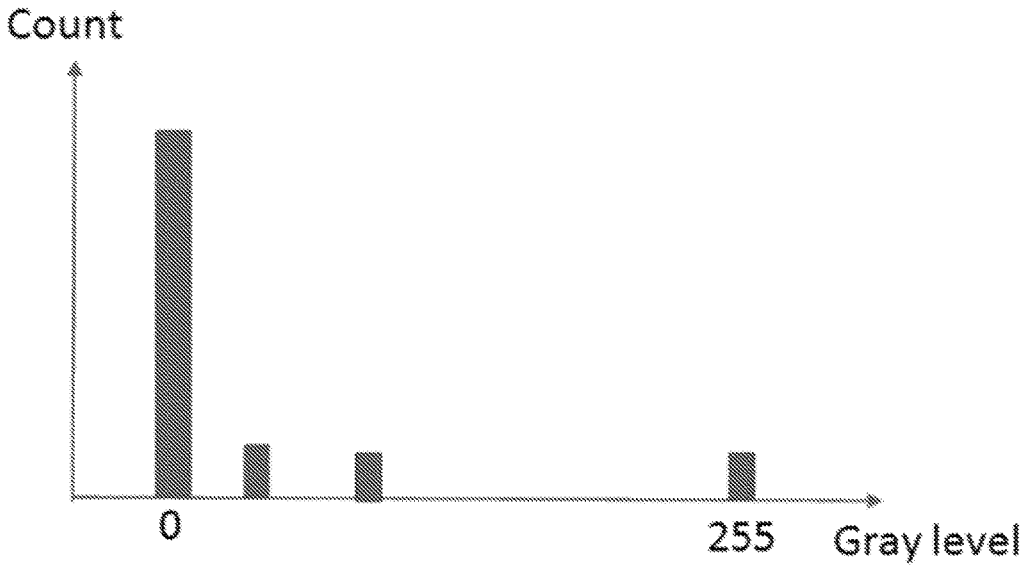
FIG. 6 illustrates example pixel counts per gray level of an input image, in accordance with an embodiment.

FIG. 6 illustrates example pixel counts per gray level of an input image, in accordance with an embodiment. In one example, the controller 340 obtains the pixel counts per gray level of the input image as shown in FIG. 6, and determines that 87% of the pixels of the display have a gray level '0', thus the controller 340 determines a dimming factor to be 15%. In addition, the controller 340 generates a light intensity control signal according to the determined dimming factor, and drives the light sources according to the light intensity control signal. Thus, light from the light sources can be dimmed according to the dimming factor. In one example, the amount of dimming can be determined based on a look up table specifying a number of pixels having the gray level '0' and a corresponding dimming factor.

By adjusting intensity of light output by the light sources according to the input image data as described herein, an image with a low luminance level (e.g., a dark color) can be displayed.

As used herein, the term "gray level" may refer to an overall gray level of the light output corresponding to a particular pixel or group of pixels of an image. As such, the dimming factor may correspond to an amount of dimming applied to all light sources of the display. In other embodiments, "gray level" may refer to a gray level or color component intensity of a particular light source type of the light sources. For example, in some embodiments, wherein the light sources comprise a red light source, a blue light source, and a green light source, separate gray levels for red, green, and blue may be determined for each pixel, wherein the gray level of a particular color for a pixel indicates an intensity of that color for the pixel. The intensity of light output for each type of light source (e.g., red, green, or blue) may be individually adjusted based upon its associated gray levels (e.g., pixel count of particular gray level values associated with the light source type).

Additional Configuration Information

The foregoing description of the embodiments has been presented for the purpose of illustration; it is not intended to be exhaustive or to limit the patent rights to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. An electronic display device comprising:

a backlight unit comprising a light source assembly having at least two different types of light sources configured to project light of different wavelength ranges based upon a received light intensity control signal, the backlight unit configured to combine the light from the plurality of light sources and to project the combined light in at least a first direction;

a liquid crystal layer configured to receive the light from the backlight unit and to control an amount of light from the backlight unit to be displayed based upon a received liquid crystal control signal;

a controller configured to:

receive input image data corresponding to an image to be displayed;

determine an amount of the entire received image data with gray level values within a predetermined threshold by, for each light source type of the at least two different types of light source of the light source assembly, determining a respective amount of the entire received image data corresponding to the light source type with gray level values within the predetermined threshold;

determine a respective dimming factor for each light source type, based upon the determined respective amounts;

generate the liquid crystal control signal based upon the received input image data; and generate the light intensity control signal, wherein the light intensity control signal is dimmed, for each light source type, by an amount specified by the determined respective dimming factor.

2. The electronic display device of claim 1, wherein the determined amount corresponds to a number of pixels of the entire received image data.

3. The electronic display device of claim 1, wherein the light source assembly comprises at least a red light source, a blue light source, and a green light source.

4. The electronic display device of claim 1, wherein the combined light is configured to be substantially white.

5. The electronic display device of claim 1, wherein the controller is further configured to: determine that the received input image data corresponds to a color not associated with a first wavelength range corresponding to a first type of light source of the at least two different types of light sources of the light source assembly; and to modify the light intensity control signal to not drive the first type of light source of the light source assembly.

6. The electronic display of claim 1, wherein the particular gray level corresponds to a gray level of 0.

7. The electronic display of claim 1, wherein determining the dimming factor comprises determining a threshold level of one or more threshold levels met by the determined amount, and setting the dimming factor to a value based upon the determined threshold level.

8. A method comprising:

receiving input image data corresponding to an image to be displayed using a display having a backlight unit with a light source assembly having at least two different types of light sources configured to project light of different wavelength ranges to be combined by the backlight unit and projected in at least a first direction;

determining an amount of the entire received image data with gray level values within a predetermined threshold by, for each light source type of the at least two different types of light source of the light source assembly, determining a respective amount of the entire received image data corresponding to the light source type with gray level values within the predetermined threshold;

determining a respective dimming factor for each light source type, based upon the determined respective amounts;

generating a light intensity control signal for driving the light source assembly of the backlight unit, wherein the light intensity control signal is dimmed, for each light source type, by an amount specified by the determined respective dimming factor; and generating a liquid crystal control signal for controlling a liquid crystal layer based upon the received input image data, wherein the liquid crystal layer is configured to receive the projected light from the backlight unit and to control an amount of light from the backlight unit that is displayed.

9. The method of claim 8, wherein the determined amount corresponds to a number of pixels of the entire received image data.

10. The method of claim 8, wherein the light source assembly comprises at least a red light source, a blue light source, and a green light source.

11. The method of claim 8, wherein the combined light is configured to be substantially white.

12. The method of claim 8, further comprising: determining that the received input image data corresponds to a color not associated with a first wavelength range corresponding to a first type of light source of the at least two different types of light sources of the light source assembly; and modifying the light intensity control signal to not drive the first type of light source of the light source assembly.

13. The method of claim 8, wherein the particular gray level corresponds to a gray level of 0.

14. The method of claim 8, wherein determining the dimming factor comprises determining a threshold level of one or more threshold levels met by the determined amount, and setting the dimming factor to a value based upon the determined threshold level.

* * * * *